United States Patent [19]

Lotspeich

[11] 4,148,412

[45] Apr. 10, 1979

[54] SHELF CONFIGURATION FOR SPIRAL VENDOR

[75] Inventor: Joseph A. Lotspeich, South Saint Paul, Minn.

[73] Assignee: Gross-Given Manufacturing Company, Saint Paul, Minn.

[21] Appl. No.: 839,817

[22] Filed: Oct. 6, 1977

[51] Int. Cl.[2] ..... G07F 11/36

[52] U.S. Cl. ..... 221/75

[58] Field of Search ..... 221/75, 261, 311, 312 R; 198/475

[56] References Cited

U.S. PATENT DOCUMENTS

| | | | |
|---|---|---|---|
| B 510,281 | 3/1976 | Cox et al. | 221/75 |
| 2,627,140 | 2/1953 | Marzolf | 198/475 X |
| 3,335,907 | 8/1967 | Holstein et al. | 221/75 |
| 4,061,245 | 12/1977 | Lotspeich | 221/75 |

*Primary Examiner*—Robert J. Spar
*Assistant Examiner*—Francis J. Bartuska
*Attorney, Agent, or Firm*—Merchant, Gould, Smith, Edell, Welter & Schmidt

[57] ABSTRACT

An improved shelf configuration for a spiral vending machine is embodied in a novel support apparatus for rotatably supporting the forward or discharge end of a helical coil used to dispense packaged food products or the like from the machine. The support apparatus comprises a first elongated coil support member transversely spaced from and parallel to a second elongated coil support member. The coil support members each define a ramp at one end respectively thereof upwardly inclined between the shelf surface on which the food products to be dispensed rest and an upper planar surface disposed above the shelf surface. The coil support members each terminate at coplanar second ends which are connected together by means of a downwardly inclined ramp. One of the coil support members adjacent the downwardly inclined ramp has a beveled inner edge portion to allow at least some products moved by the coil to be oriented in a transversely tilted position immediately before dispensing. The coil support members are transversely spaced apart at a sufficient distance so as to cause the front portion of the dispensing coil to be supported by the upper planar surfaces of the coil support members, at a position spaced above the shelf surface.

3 Claims, 5 Drawing Figures

SHELF CONFIGURATION FOR SPIRAL VENDOR

BACKGROUND OF THE INVENTION

1. Field of the Invention

The present invention relates in general to vending machines having helical dispensing coils and, more particularly, to an improved configuration for the forward end of a product shelf in such a machine comprising a support member for rotatably supporting the front end of an elongated helical coil above the surface of the shelf.

2. Description of the Prior Art

The use of helical coils in vending machines as a means for transporting articles to be vended from a location in the interior of the machine to a discharge point is well known. Typically, the vending coil is used in conjunction with a horizontal support tray or shelf. The articles to be vended are placed within the convolutions of the vending coil and are supported by the tray or shelf. Upon rotation of the vending coil, the articles to be dispensed is longitudinally advanced along the shelf until it reaches the front end of the shelf. Upon further rotation of the vending coil, the article to be dispensed is forced over the front edge of the shelf and falls into a discharge bin where it may be manually removed by the person operating the vending machine.

U.S. Pat. No. 3,993,215 to Cox et al illustrates a vending coil support structure typically used in the prior art. In the Cox structure, the dispensing coil rides within a trough formed within a shelf. The forward end of the shelf is configured to form a notch, when viewed above, with a forwardly projecting ledge at one side of the notch. The dispensing coil is disposed with its forward end extending over the notch and the lower end of its forwardmost convolution extending over the notch to support the next item to be dispensed at one side thereof above the notch, with the other side of the item being supported on the projecting ledge. During a dispensing cycle, as the coil rotates, the lower convolution portion which supports the item to be dispensed is withdrawn from beneath the item, allowing the item to tip sideways and to fall under the force of gravity through the notch and into an underlying collection bin.

The Cox apparatus was specifically designed for vending machines having relatively closer tolerances between the front of the helix and the front door of the cabinet, where it is desirable to cause the item being dispensed to tip to the "side" rather than "forward" during the dispensing cycle. This apparatus was particularly designed for dispensing relatively light-weight bag packaged articles such as potato chips, pretezels and the like which would have a tendency to hang-up or become bridged between the shelf and the front door of the machine, if such articles would be dispensed so as to tip-over in the forward longitudinal direction of the coil. While the side-tipping dispensing apparatus of Cox addressed the bridging problem associated with dispensing bag-type articles, the structure was susceptible to jamming or catching of the bag-type package being dispensed between the lower surface of the dispensing coil and the upper surface of the trough.

The inventor's prior U.S. patent application Ser. No. 669,348 filed Mar. 22, 1976, now issued as U.S. Pat. No. 4,061,245, described an improved helical-coil dispensing apparatus, generally operable in a side-tipping manner, which overcomes the jamming or catching deficiencies of the Cox-type apparatus. This apparatus does not require a coil-guide trough along the entire length of the dispensing coil, but has means for supporting the opposite ends of the dispensing coil such that the lower most portions of the opposite ends are exposed above and spaced from the horizontal shelf surface on which the items to be dispensed are being supported. A coil support member mounted at the forward end of the shelf is configured to rotatably support the forward end of the coil such that the lower extremity of the coil does not engage the shelf surface, and thus cannot catch the package of the article being dispensed therebetween.

One type of such support member for the forward end of the dispensing shelf is disclosed in FIGS. 4–6 of the Inventor's above-referenced prior patent. Such a support member includes two parallel, transversely spaced coil support members having upper planar surfaces disposed above the level of the shelf surface, for supporting the dispensing coil thereon. A first end of each of the coil support members is provided with an upwardly extending ramp which guides articles to be dispensed and moved by the coil from the primary shelf surface to the upper planar surfaces of the coil support members. A second end of one of the support members projects outwardly beyond the front end of the shelf, and the second end of the other coil support member terminates at a position approximately coincident with the front edge of the shelf. This forms, in effect, a laterally offset notch as viewed from above, at the forward end of the shelf. The article to be next dispensed is supported and dispensed in a manner similar to that above-described with respect to the Cox apparatus.

While both of the above-described side-tipping dispensing structures work effectively with relatively light-weight bagpackaged type items such as potato chips and pretzels, their structure is less effective for dispensing relatively heavy or bulky boxed items, for example, those candy box sizes commonly known in the art as "theatre packs". When such heavy or bulky boxed items are supported in a cantilever manner by the forwardmost convolution of the helical coil as above-described, the weight of the article to be dispensed can distort the forwardmost convolution extending over the notch, and can occasionally allow the box to slip through the coil and drop into the collection or discharge bin before the vending cycle has been initiated. When further considering the thickness of the box to be dispensed, the distance between adjacent convolutions must be increased, further adding to the above-described potential problem.

The present invention overcomes the deficiencies of the prior art helical coil dispensing structures for dispensing heavy or boxed items by providing a level coil support apparatus for mounting at the forward edge of a shelf, which gives positive and reliable forward-tipping dispensing of such items in an efficient and tamper-proof method.

SUMMARY OF THE INVENTION

The present invention provides an improved configuration for the shelf of a vending machine, comprising a coil support apparatus which supports the front end of a dispensing coil above the general plane of the dispensing shelf, and is particularly effective for use in vending relatively large and heavy items, such as boxed food products.

The coil support apparatus comprises first and second elongated coil support members having first and second planar surfaces respectively disposed above the shelf surface. The first and second coil support members are spaced apart a sufficient distance such that a dispensing coil is rotatably supported by the planar surfaces thereof, at a position above and spaced apart from the shelf surface. Both coil support members are essentially of equal length. One end of each of the coil support members forms an inclined ramp by which articles to be dispensed are conveyed by the dispensing coil as it rotates, from the shelf surface to the upper planar surface of the support members. The other ends respectively of the support members project slightly outward from the front edge of the shelf where they are integrally connected together by means of a downwardly extending ramp which asists in the discharge of the dispensed articles from the helical coil. In a preferred embodiment of the invention, one of the support members has a portion of its inner edge beveled outwardly, to allow articles of appropriate size to become transversely tilted before discharge, to further assist in the discharge of article from the vending machine.

BRIEF DESCRIPTION OF THE DRAWING

The present invention will be described in more detail hereafter in conjunction with the following drawings, wherein like numerals represent like parts throughout the several views, and in which.

DESCRIPTION OF A PREFERRED EMBODIMENT

Figure 1:
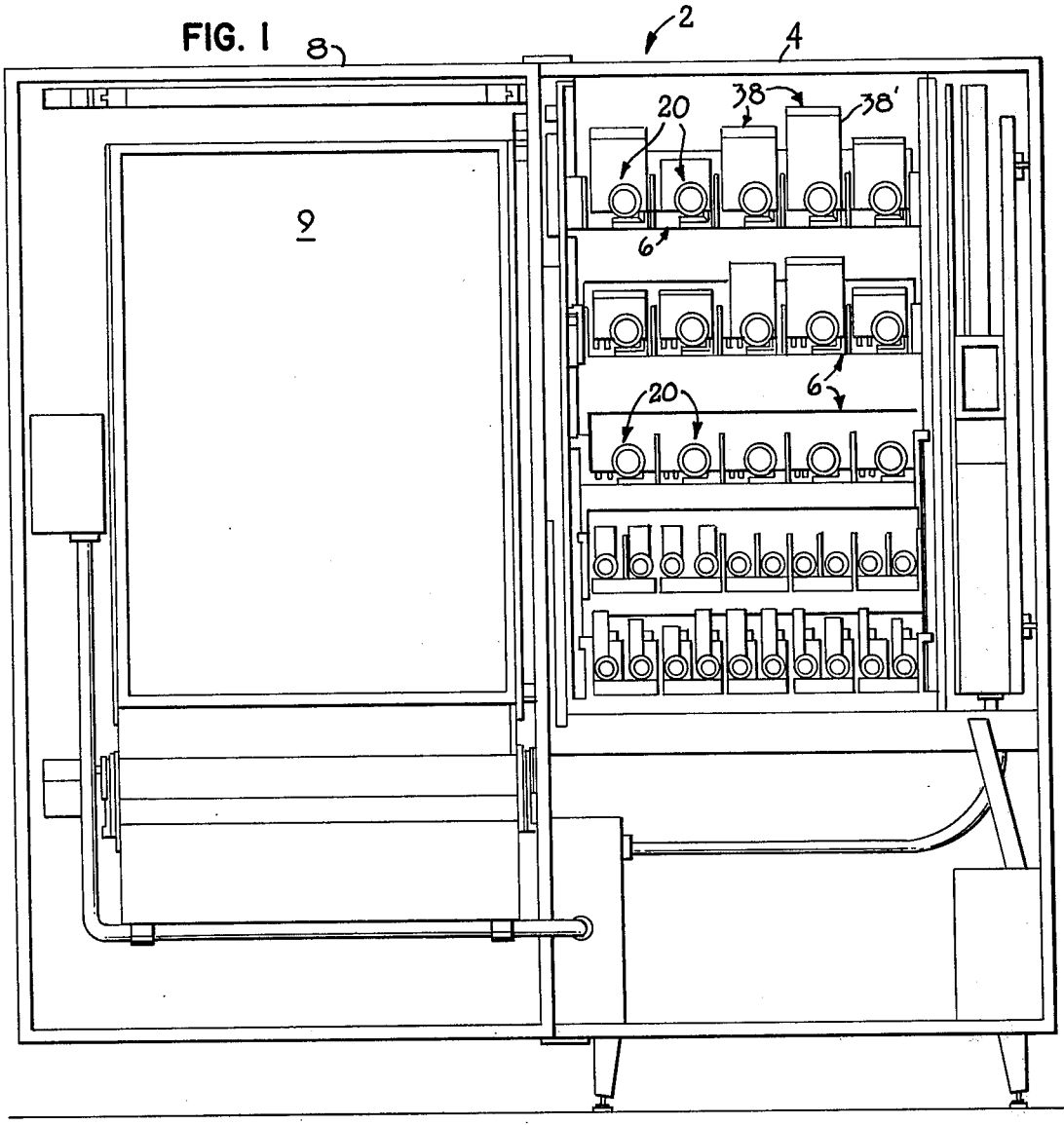
FIG. 1 is a view in front elevation of a vending machine of the present invention showing a possible arrangement of a plurality of support shelves within the vending machines and a plurality of vending coil units overlying the respective support shelves.
Figure 2:
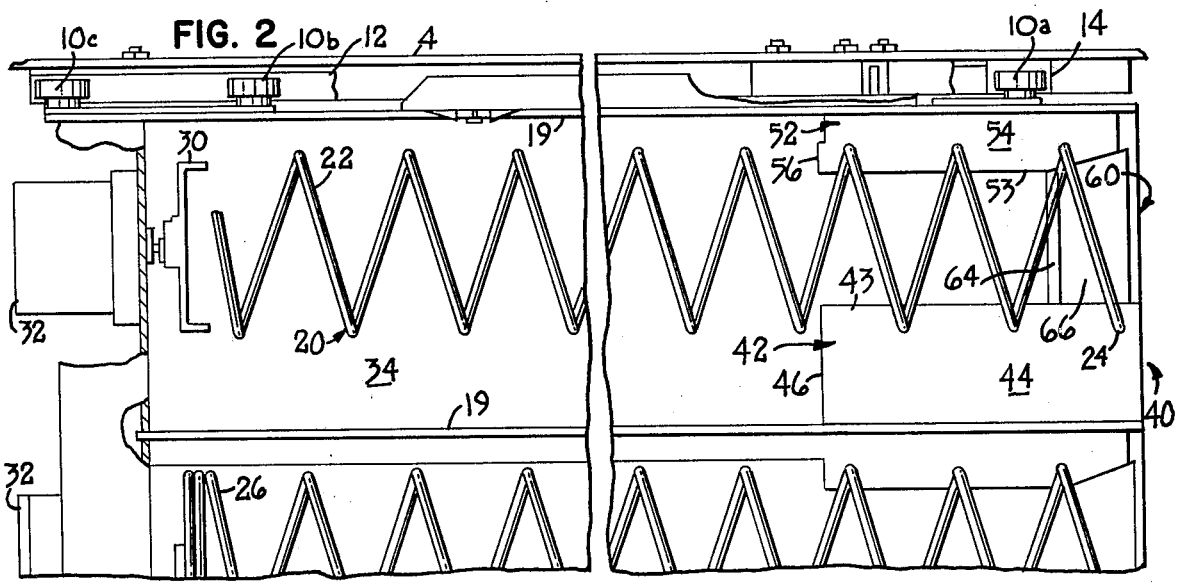
FIG. 2 is a fragmentary top plan view of a portion of one of the support shelves of the vending machine disclosed in FIG. 1, as generally viewed along the plane of Lines 2—2 in FIG. 1.

Referring to FIG. 1, the present invention is designed for use in a vending machine of a helical coil type, suitable for dispensing prepackaged food products. In particular, the present invention is designed for use in a vending machine 2 of the type disclosed in the inventor's prior application, U.S. Ser. No. 669,348, now U.S. Pat. No. 4,061,245, which application is hereby incorporated by reference. The details of such a vending machine 2 will be described herein only insofar as is necessary to an understanding of the present invention.

Vending machine 2 is provided with an outer housing 4 having a plurality of vertically spaced, horizontally disposed dispensing shelves or trays 6 slidably mounted therein. Vending machine 2 also has a front door member 8, shown in its open position in FIG. 1, pivotally mounted to outer housing 4. Door member 8 is normally locked in a closed position to cover the shelves 6 contained within the internal cavity of housing 4. A window 9 is provided in door 8 so that a person contemplating the purchase of a dispensible item may view the various products contained on the shelves 6 when the door 8 is closed.

Each of the shelves 6 is movably mounted in housing 4 by a plurality of rollers 10*a*–10*c* which ride in U-shaped channels 12 attached to the sides of housing 4 so that the shelves 6 can be rolled out of housing 4 for loading food products therein. A front stop 14 is provided at the front end of each of the channels 12 for holding the shelves 6 in their normal operative position within housing 4. At least some of the shelves 6 may have additional structure allowing them to be pulled out and tilted down relative to housing 4 to ease the task of loading them with dispensible articles, as generally described in the inventor's above-referenced patent application.

Each of the dispensing shelves 6 contains a plurality of transversely spaced dispensing coil units 20. Each dispensing coil unit 20 contains an elongated, generally rigid helical dispensing coil 22 extending from the front to the back of housing 4. Each coil 22 is convoluted and has a generally circular cross-section with a front portion terminating in a first terminal 24 and a rear portion terminating in a second terminal 26. The second terminal 26 and the rearmost convolutions of each coil 22 are welded or otherwise fixedly attached to a cross-bracket 30. The cross-bracket 30 of each coil is releasably coupled to an electric motor 32, operable to rotate the coil 22 in the dispensing direction (i.e. clockwise as viewed in FIG. 1). The cross-brackets 30 and the motors 32 are positioned relative to the respective shelves 6, so as to support the rearward end of the coils 22 above the planar shelf surface 34 of shelf 6, which terminates at a front edge 36. The cross-bracket and motor connections are preferably of the type disclosed in the inventor's above-referenced patent application.

Referring to FIGS. 2–5, the present invention relates in particular to an improved apparatus for rotatably supporting the front end of each dispensing coil 22 at a position above and spaced from the shelf surface 34. The apparatus of this invention is particularly suited for use in those trays or shelves 6 which hold large bulky food items, such as potato chips, pastries, and the like, and for even larger and heavier food products, such as boxed food items such as Cracker Jacks, and other candy items packaged in what are commonly known as "theatre-pack" boxes. As illustrated in FIG. 1, devices constructed according to the principles of the present invention would be particularly suitable for dispensing the boxed food products 38 carried by the uppermost shelves 6 in housing 4.

The support apparatus 40 of the preferred embodiment of the invention comprises a first elongated coil support member 42 having an upper planar surface 44 disposed generally parallel to and spaced above the shelf surface 34. A second elongated coil support member 52 defines an upper planar surface 54 disposed generally parallel to and spaced above the shelf surface 34. The support members 42 and 52 are transversely spaced apart a sufficient distance so as to fit between transversely spaced side walls 19 which lie along the longitudinally extending sides of each of the dispensing coils 22 in shelf 6. The side walls 19 guide the food products as they are moved forwardly by coil 22 along shelf 6. Each cooperating pair of the support members 42 and 52 are transversely spaced apart a sufficient distance so as to cooperatively support one of the dispensing coils 22 on the planar surfaces 44 and 54 thereof. In other words, the respective inner edges 43 and 53 of the coil support members 42 and 52 are spaced apart by a distance which is somewhat less than the outer diameter of the dispensing coil 22, as clearly shown in FIG. 2, such that the lower surface of the coil 22 is spaced from and not in engagement with the shelf surface 34.

Each of the coil support members 42 and 52 terminates at a first end 46 and 56, respectively, characterized by an upwardly inclined ramp portion which extends between the shelf surface 34 and the planar surfaces 44 and 54 of the respective support members 42 and 52. The portions 46 and 56 are operable to convey or lift articles to be dispensed from the shelf surface 34 to the planar surfaces 44 and 54. Each of the coil support members 42 and 52 also projects outwardly from the front edge 36 of the shelf surface 34 and terminates at a second end 48 and 58, respectively, which is spaced from the front edge 36 of shelf 34 by a distance approximately equal to the pitch of the dispensing coil 22. The second end 48 of support member 52 is provided with display panels 49 for displaying price or product information regarding the items 38 being carried by the respective coils 22.

The support members 42 and 52 are integrally connected at their respective ends 48 and 58 by a transversely extending beam member 60. The beam member 60 is provided with a rear wall 62 adapted to matingly engage the front edge 36 of the shelf 34. A horizontal portion 64 of that top surface of the beam member 60 which lies immediately adjacent the front edge 36 of shelf 34 forms a continuation of the shelf surface 34. A downwardly inclined ramp portion 66 leads from the horizontal portion 64 of the beam member 60 to a second end 68 of the beam member 60 to assist in the discharge of articles 38 from the vending machine 2 in a manner to be described hereafter. The second end 68 of the beam member 60 is substantially coplanar with the second ends 48 and 58 respectively of the support members 42 and 52.

The first and second coil support members 42 and 52 are each respectively provided with a downwardly extending internally threaded boss 69 designed to receive a threaded screw 70 for detachably holding the support apparatus 40 on the dispensing shelf surface 34. In the preferred embodiment, the second coil support member 52 is not as wide as the first coil support member 42. The support member 52 has an outwardly beveled portion 72 along its inner edge 53 adjacent the entire length of the beam member 60 to further assist in the discharge of articles from the machine. The support apparatus 40 is preferably integrally molded out of a hard plastic material as a one-piece unit; however, support apparatus 40 could be formed out of other materials, such as metal, if so desired.

The shape of the coil support apparatus 40 described above is particularly advantageous for dispensing large boxed food items 38, such as Cracker Jacks and the like, particularly when the items 38 have a width greater than the distance between the first and second coil support members 42 and 52, but less than the distance between the support members 42 and 52 at the outer end of the beveled portion 72 of the second support member 52. Normally, a supply of such boxes 38 are supported in a longitudinal row from front to back on the shelf surface 34 between the side walls 19. The rotation of coil 22 will advance the row of boxes along the shelf during a dispensing cycle. When the advancing boxes 38 encounter the ramp portions 46 and 56 of the first and second coil support members 42 and 52, they will be raised by continued rotation of the coil 22, from the shelf surface 34 and up to the upper planar surfaces 44 and 54 of the support members for support thereby. The forwardmost box 38', (i.e., the next box to be dispensed) will be longitudinally retained between the last convolution of coil 22, as illustrated generally by FIG. 2, with the laterally opposite sides of the box 38 being firmly supported by the upper planar surfaces 44 and 54 of the coil suppport members 42 and 52 respectively.

Figure 3:
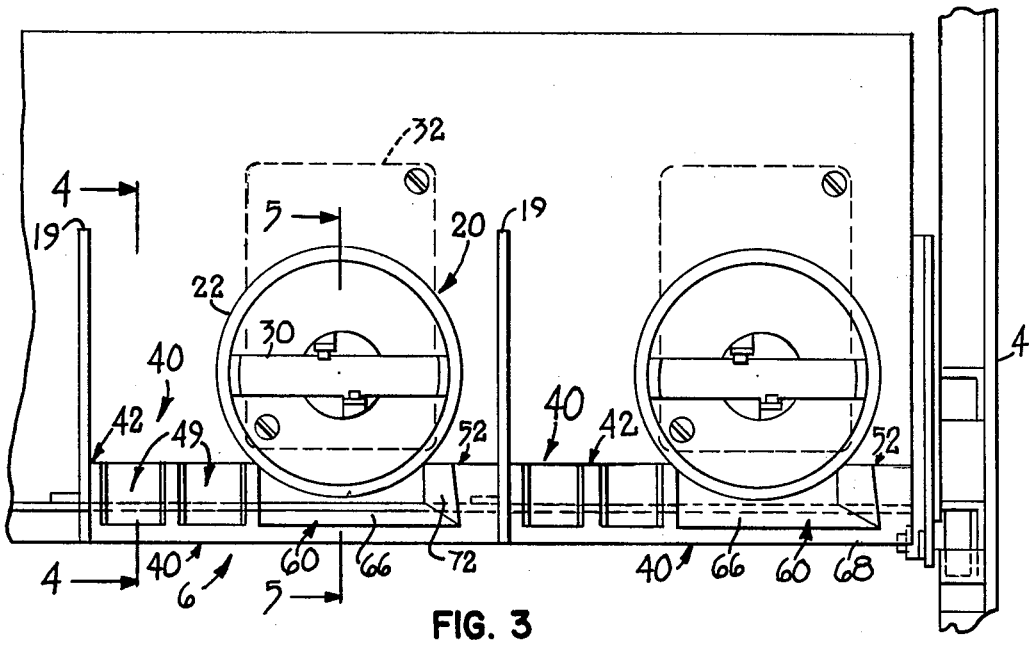
FIG. 3 is an enlarged fragmentary view in front elevation of a vending coil unit and its associated underlying shelf, as disclosed in FIG. 1.
Figure 4:
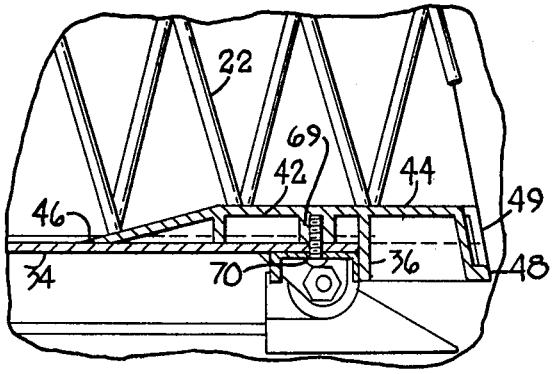
FIG. 4 is a fragmentary section view of a portion of a vending coil unit and underlying support shelf disclosed in FIG. 3, taken along Lines 4—4 in FIG. 3.
Figure 5:
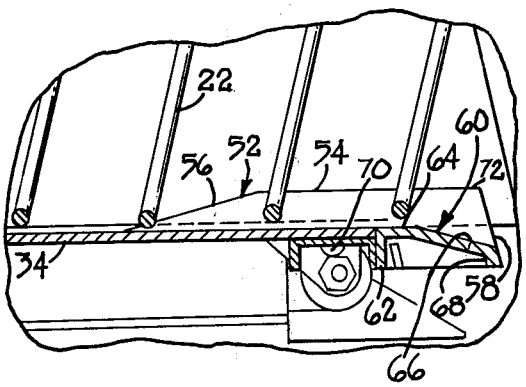
FIG. 5 is a fragmentary section view of a portion of a vending coil unit and underlying support shelf disclosed in FIG. 3, taken along the Lines 5—5 of FIG. 3.

When it is desired to dispense the front box 38' from a particular vending coil 22, appropriate operating means (not illustrated) will cause rotation of the desired coil 22 in the dispensing direction (clockwise in FIGS. 1 and 3). As the coil 22 begins rotating, the coil will urge the box 38' forwardly along the upper surfaces 44 and 54 until the left side of the box 38' begins to encounter the beveled portion 72 on the second coil support member 52. As the box 38' moves further forward, the left side of the box 38' will advance over an increasingly larger void defined by the beveled portion 72 until that side is no longer supported by the upper surface 54. At that instant, if the weight of the boxed item 38' is sufficiently large, as it probably would be for most boxed food products, then box 38' will distort the coil 22 sufficiently to allow the left side of the box 38' to drop until it engages the downwardly inclined ramp 66. In this position, box 38' is transversely tilted about its center of mass with the left side of the box being supported by the ramp 66 and the right side of the box 38' being supported by the first coil support member 42. As the dispensing cycle continues, box 38' will finally be pushed entirely clear of the support apparatus 40 in the longitudinal direction of the coil. However, because the box 38' has already been tilted by engagement of its lower left edge with the ramp 66, it will tend to fall forward and to one side, thereby lessening the chances of the box 38' hanging up on the door member 8 of vending machine 2. With heavier items, however, the chances of a dispensed article hanging up on the door are significantly reduced due to the momentum of the article as it begins its downward motion.

Thus, the improved coil support apparatus 40 insures proper, reliable and efficient dispensing of articles 38 from the vending machine 2 without utilizing a shelf configuration having an open notch in which the food articles are not firmly supported on both sides. Furthermore, even though it might be possible to operate a vending machine having an open notch at the front of the shelf or tray in a manner such that boxed items are normally stopped short of the notch before the vending cycle is commenced, the support apparatus 40 of the present invention yields a margin of safety and reliability not present with dispensing apparatus of the type having "open notch" support members. In operation of the open notch type of apparatus it is possible for the foremost boxed item 38 to be pushed beyond the forward ends of the spaced coil support members if the dispensing coil should, for any reason, rotate slightly more than a single revolution during a vending cycle. In this event, the most forward item would be supported by the coil at only one side, thereby giving rise to the possibility of that item falling through the forward convolutions of the coil 22, unless a precise degree of control over rotation of the dispensing coil 22 is achieved. In contrast, with use of the support apparatus 40 of the present invention, even if the dispensing coil 22 should rotate more than 360° on any dispensing cycle, such that the front item 38 is advanced beyond the desired "ready" position for the beginning of the next vending cycle, the item 38 could not fall into the delivery or collection bin since it would be guided by the beveled portion 72 into supporting engagement by the ramp 66. Therefore, in such event, the item 38 is retainably held by the support apparatus 40, and does not fall down into the discharge bin 11, even though the dispensing coil 22 has exceeded its normal rotation during previous dispensing cycle operations.

When the support apparatus 40 is used with boxed items 38 having a width greater than the width between the coil support members 42 and 52, even at the widest part of the beveled portion 72, the transverse tilting preorientation of the box 38 does not occur. When such wider items 38 are to be dispensed, the vending machine 2 should be designed such that sufficient space exists between the front edge 36 of shelf surface 34 and the door member 8 to allow the item 38 to fall forward from the front of the support apparatus without hanging up on the door member 8.

The support apparatus 40 of the present invention can also be used to dispense very narrow food items having a width less than the spacing between the support members 42 and 52. In this event, the items are contained between the convolutions of the coil and are advanced along the shelf as previously described with respect to the boxed items 38. However, because the items have a width less than the distance between the coil support members 42 and 52, the items never engage the ramp portions 46 and 56 of those members, and are not raised out of engagement with the shelf surface 34. Instead, the items to be dispensed proceed down the shelf surface 34 between the coil support members 42 and 52 until they engage the downwardly extending ramp 66 of the support apparatus 40. Continued rotation of the coil 22 will then push these items entirely clear of the ramp 66, allowing them to fall downwardly to the discharge bin of the vending machine.

It is apparent that various modifications of the invention can be made by those skilled in the art without departing from the spirit and intent of this invention. The preferred embodiment shown and described herein is only intended to provide a concrete example of implementation of the invention. Accordingly, the scope of the invention is to be limited only by the appended claims.

I claim:

1. Support apparatus for rotatably supporting an elongated semi-rigid helical coil, of the type used for dispensing articles from a dispensing machine, above a substantially planar shelf surface having a front edge, comprising:

(a) a first elongated coil support member defining a first generally planar upper surface disposed to lie above and generally parallel to a shelf surface and adjacent a front edge thereof, said first upper surface being terminated at first and second longitudinally opposed ends thereof, wherein said first end of said first coil support member defines a first ramp surface forming an inclined continuum in the longitudinal direction of said first coil support member between said shelf surface and said first upper surface;

(b) a second elongated coil support member defining a second generally planar upper surface disposed to lie above and generally parallel to said shelf surface and adjacent said front edge thereof, said second upper surface being terminated at first and second longitudinally opposed ends thereof, wherein said first end of said second coil support member defines a second ramp surface forming an inclined continuum in the longitudinal direction of said second coil support member between said shelf surface and said second upper surface;

(c) said first and said second coil support members being disposed in spaced, generally parallel relationship to one another such that said first and said second ramp surfaces lie generally in the same plane, and wherein said first and said second coil support members are laterally spaced apart from one another a sufficient distance to cooperatively support a helical coil on and between said first and said second upper surfaces such that the lower surface of the said supported coil is disposed to lie above and spaced apart from said shelf surface; and (d) wherein said first and second coil support members each respectively has a lateral width defined by inner and outer edges thereof extending between said first and said second ends thereof, and wherein that portion of said inner edge of said second coil support member which lies adjacent said second end thereof is beveled outwardly in the longitudinal direction of said second coil support member to further assist the discharge of articles from the dispensing machine.

2. An improved configuration for the forward end of a shelf in a vending machine having at least one rotatable helical coil disposed above the shelf, the coil having a plurality of convolutions for consecutively dispensing a plurality of articles over the forward end of the shelf, said improved configuration being suitable for dispensing relatively heavy articles, comprising:

(a) first and second elongated support members defining respectively first and second upper planar surfaces, said first and said second support members being transversely spaced apart by a distance less than the diameter of the coil such that the coil is rotatably supported by said first and said second planar surfaces, said first and said second support members each further respectively having one end, said one ends respectively terminating in substantially coplanar positions to define the forward end of the shelf;

(b) an elongated beam member connecting said one ends of said first and second support members together at a position below said upper planar surfaces to define a substantially U-shaped trough over which the coil extends at the forward end of the shelf; and (c) wherein one of said support members has an inner edge beveled outwardly in the longitudinal direction of said one support member adjacent said first end thereof to gradually decrease the lateral width of said one support member in the forward direction thereof, whereby a first edge of a first article being dispensed is allowed to fall downwardly to be supported by said beam member until said first article is dispensed over the forward end of the shelf, thereby orienting said first article in a transversely tilted position to facilitate proper dispensing over the forward end of the shelf.

3. An improved configuration according to claim 2, wherein said first and second support members and said beam member are integrally formed in a single support apparatus, said support apparatus being removably attached to a front edge of the shelf to define the forward end thereof.

* * * * *

UNITED STATES PATENT AND TRADEMARK OFFICE

CERTIFICATE OF CORRECTION

PATENT NO. : 4,148,412

DATED : April 10, 1979

INVENTOR(S) : Joseph A. Lotspeich

It is certified that error appears in the above-identified patent and that said Letters Patent are hereby corrected as shown below:

In column 1, line 21, for "articles" read --article--.
line 32, for "when viewed above" read --when viewed from above--.

In column 2, line 34, for "bagpackaged" read --bag-packaged--.

In column 3, line 14, for "asists" read --assists--.

Signed and Sealed this

*Eleventh* Day of *September 1979*

[SEAL]

*Attest:*

*Attesting Officer*

LUTRELLE F. PARKER

*Acting Commissioner of Patents and Trademarks*